US009016083B2

(12) United States Patent
Okuda et al.

(10) Patent No.: US 9,016,083 B2
(45) Date of Patent: Apr. 28, 2015

(54) AIR REFRIGERANT TYPE FREEZING AND HEATING APPARATUS

(75) Inventors: Seiichi Okuda, Kanagawa (JP); Shigemitsu Kikuchi, Kanagawa (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 532 days.

(21) Appl. No.: 12/885,933

(22) Filed: Sep. 20, 2010

(65) Prior Publication Data

US 2011/0005252 A1 Jan. 13, 2011

Related U.S. Application Data

(63) Continuation of application No. 10/524,692, filed as application No. PCT/JP2004/017711 on Nov. 29, 2004, now abandoned.

(51) Int. Cl.

| | |
|---|---|
| ***F25B 27/00*** | (2006.01) |
| ***F25D 9/00*** | (2006.01) |
| ***F25B 17/00*** | (2006.01) |
| ***F25B 9/00*** | (2006.01) |

(Continued)

(52) U.S. Cl.

CPC ..... *F25B 9/004* (2013.01); *F24D 17/0005* (2013.01); *F24D 17/0089* (2013.01); *F24D 17/0052* (2013.01); *F24D 2200/16* (2013.01); *F25B 29/00* (2013.01)

USPC ..... 62/402

(58) Field of Classification Search

CPC ..... F24D 2200/16–2200/32; F24D 2200/12; F24D 2200/123; F25J 1/0242

USPC ..... 62/238.2, 324.1–324.2, 331, 401, 402

See application file for complete search history.

(56) References Cited

U.S. PATENT DOCUMENTS

| | | | |
|---|---|---|---|
| 2,118,949 | A | 2/1935 | Scott |
| 2,706,894 | A | 4/1955 | Shoemaker |

(Continued)

FOREIGN PATENT DOCUMENTS

| | | | |
|---|---|---|---|
| EP | 1130331 | A2 | 9/2001 |
| FR | 1048070 | A | 12/1953 |

(Continued)

OTHER PUBLICATIONS

Machine translation of JP2003-302116A performed by http://www4.ipdl.inpit.go.jp/Tokujitu/tjsogodben.ipdl?N0000=115.*

(Continued)

*Primary Examiner* — John F Pettitt
*Assistant Examiner* — Tareq Alosh
(74) *Attorney, Agent, or Firm* — Kanesaka, Berner & Partners

(57) ABSTRACT

An air refrigerant type freezing and heating apparatus has a compressing mechanism that compresses an air refrigerant. As the air refrigerant is heated by a first heat exchanger and further heated by a heater, the temperature of the air refrigerant is increased to more than 200° C. and the air refrigerant is supplied to an oven. Heat of the air refrigerant outputted from the oven is recovered by a second heat exchanger, and supplied to a high-temperature side of the first heat exchanger. The air outputted from the second heat exchanger is cooled by a cooler and a third heat exchanger, is adiabatically expanded by an expansion turbine to be cooled to −85° C., and is supplied to a freezer. The air of the freezer is recovered to be supplied to the low-temperature side of the third heat exchanger, and then is supplied to the compressor.

9 Claims, 3 Drawing Sheets

(51) Int. Cl.
*F24D 17/00* (2006.01)
*F25B 29/00* (2006.01)

(56) References Cited

U.S. PATENT DOCUMENTS

| | | | | |
|---|---|---|---|---|
| 2,733,574 | A | | 2/1956 | Reber, Jr |
| 3,321,930 | A | * | 5/1967 | La Fleur ..... 62/228.4 |
| 3,355,903 | A | * | 12/1967 | La Fleur ..... 62/88 |
| 3,355,905 | A | | 12/1967 | Berhold et al. |
| 3,696,637 | A | | 10/1972 | Ness et al. |
| 3,792,595 | A | | 2/1974 | Willis |
| 4,328,684 | A | | 5/1982 | Leo |
| 4,483,153 | A | | 11/1984 | Wallace |
| 4,539,816 | A | * | 9/1985 | Fox ..... 62/87 |
| 4,730,464 | A | | 3/1988 | Lotz |
| 5,014,521 | A | | 5/1991 | Sakai et al. |
| 5,237,837 | A | | 8/1993 | Naruse et al. |
| 5,248,239 | A | | 9/1993 | Andrews |
| 5,279,130 | A | | 1/1994 | Donaldson |
| 5,644,928 | A | | 7/1997 | Uda et al. |
| 5,884,498 | A | | 3/1999 | Kishimoto et al. |
| 5,924,307 | A | | 7/1999 | Nenov |
| 6,148,622 | A | | 11/2000 | Sanger |
| 6,151,909 | A | | 11/2000 | Carter et al. |
| 6,164,084 | A | | 12/2000 | Watson et al. |
| 6,260,375 | B1 | | 7/2001 | Kuo |
| 6,381,973 | B1 | | 5/2002 | Bhatti et al. |
| 6,415,621 | B2 | | 7/2002 | Buchholz et al. |
| 6,481,232 | B2 | | 11/2002 | Faqih |
| 6,672,081 | B1 | | 1/2004 | Albaroudi et al. |
| 6,848,261 | B2 | | 2/2005 | Claeys |
| 6,868,693 | B2 | | 3/2005 | Choi |
| 6,941,770 | B1 | * | 9/2005 | Taras et al. ..... 62/512 |
| 7,040,100 | B2 | | 5/2006 | Feisthauer |
| 2003/0024254 | A1 | | 2/2003 | Yoshida et al. |

FOREIGN PATENT DOCUMENTS

| | | | | |
|---|---|---|---|---|
| GB | 2237373 | A | | 5/1991 |
| JP | 56018883 | U | | 2/1981 |
| JP | 61-27994 | U | | 2/1986 |
| JP | 5-106944 | A | | 4/1993 |
| JP | 6-34212 | A | | 2/1994 |
| JP | 6-32123 | U | | 4/1994 |
| JP | 06101498 | A | | 4/1994 |
| JP | 7-91760 | A | | 4/1995 |
| JP | 07324789 | | | 12/1995 |
| JP | 8061366 | A | | 3/1996 |
| JP | 8061821 | A | | 3/1996 |
| JP | 9178323 | A | | 7/1997 |
| JP | 9196485 | A | | 7/1997 |
| JP | 09-217976 | A | | 8/1997 |
| JP | 9236341 | A | | 9/1997 |
| JP | 10089823 | A | | 4/1998 |
| JP | 10-148408 | A | | 6/1998 |
| JP | 10-160195 | A | | 6/1998 |
| JP | 10267444 | A | | 10/1998 |
| JP | 11-55899 | A | | 2/1999 |
| JP | 11063792 | A | | 3/1999 |
| JP | 11-132582 | A | | 5/1999 |
| JP | 11-132583 | A | | 5/1999 |
| JP | 2000002481 | A | | 1/2000 |
| JP | 2000314569 | A | | 11/2000 |
| JP | 2000-356425 | A | | 12/2000 |
| JP | 2001-123997 | A | | 5/2001 |
| JP | 2001-221551 | A | | 8/2001 |
| JP | 2002-112475 | A | | 4/2002 |
| JP | 2002-120000 | A | | 4/2002 |
| JP | 2003-83634 | A | | 3/2003 |
| JP | 2003083634 | A | * | 3/2003 |
| JP | 2003-279183 | A | | 10/2003 |
| JP | 2003-287299 | A | | 10/2003 |
| JP | 2003-302116 | A | | 10/2003 |
| JP | 2003287298 | A | | 10/2003 |
| JP | 2003302116 | A | * | 10/2003 |
| KR | 20030031540 | A | | 4/2003 |
| WO | 8603825 | A1 | | 7/1986 |

OTHER PUBLICATIONS

Machine translation of JP2003-083634A performed by http://www4.ipdl.inpit.go.jp/Tokujitu/tjsogodben.ipdl?N0000=115.*
Search Report for PCT/JP2005/000107 mailed Apr. 19, 2005.
JP Office Action for JP2006-528433, corresponding to U.S. Appl. No. 10/524,692, mailed Mar. 13, 2009.
JP Office Action for JP2006-546517, corresponding to U.S. Appl. No. 10/524,631, mailed Aug. 6, 2009.
JP Office Action for JP2006-527788, corresponding to U.S. Appl. No. 10/524,692, mailed Aug. 6, 2009.
Office Action for JP2006-527781, dated Mar. 16, 2009.
Trial decision in JP2006-527788, dated May 11, 2011.
Office Action for U.S. Appl. No. 12/913,505 dated Dec. 21, 2011.
European Search Report for 04822210.3 dated Feb. 29, 2012.
Office Action for U.S. Appl. No. 12/913,505 issued Jul. 20, 2011.
European Search Report dated Sep. 5, 2011.
Office Action as issued on Mar. 5, 2013 in related U.S. Appl. No. 12/849,653.
European Search Report issued Feb. 17, 2015, corresponding to European patent application No. 05746013.1.

* cited by examiner

AIR REFRIGERANT TYPE FREEZING AND HEATING APPARATUS

RELATED APPLICATIONS

The present Application is a continuation of U.S. patent application Ser. No. 10/524,692, filed on Oct. 17, 2006 now abandoned, which in turn claims priority to International Application Number PCT/JP2004/17711, filed on Nov. 29, 2004, the disclosures of which are hereby incorporated by reference herein in their entirety.

TECHNICAL FIELD

The present invention relates to an air refrigerant type freezing apparatus.

BACKGROUND ART

Recently, a cooling apparatus using the air as a refrigerant has been developed in place of a conventional cooling apparatus using chlorofluorocarbon as a refrigerant.

Japanese Laid Open Patent Application JP-A-Heisei 11-132582 discloses an air refrigerant type freezing apparatus having a compressor, an air cooler, an air-to-air heat exchanger, and an expansion unit arranged in an order of an air flow, taking air of a chamber required to be cooled into the compressor through the air-to-air heat exchanger, and blowing off the air outputted from the expansion unit into the chamber, characterized by including a first bypass provided with a valve for returning a part of or all of the air from the expansion unit to the air-to-air heat exchanger while bypassing the chamber, and a hot air bypass provided with a valve for taking in the air at 0° C. or higher from an air passage between the compressor and the expansion unit, and for supplying the air to an air passage on an inlet side of the air-to-air heat exchanger.

DISCLOSURE OF INVENTION

An object of the present invention is to provide an apparatus which supplies heat with a high efficiency by a heat cycle of an air refrigerant.

Another object of the present invention is to provide an apparatus which simultaneously performs freezing and heating by a heat cycle of an air refrigerant.

An air refrigerant type freezing and heating apparatus according to the present invention includes: a compressing mechanism which compresses an air refrigerant; a heating unit which heats a object by the air refrigerant outputted from the compressing mechanism; a heat exchanger which cools the air refrigerant outputted from the heating unit; a turbine which expands the air refrigerant outputted from the heat exchanger; and a cooler which cools a object by the air refrigerant outputted from the turbine.

In the air refrigerant type freezing and heating apparatus according to the present invention, the compressing mechanism is composed of a single compressor.

In the air refrigerant type freezing and heating apparatus according to the present invention, the compressing mechanism is a compressor that rotates coaxially with the turbine. The air refrigerant taken in from the cooler is supplied to a low-temperature side flow passage of the heat exchanger, and the air refrigerant outputted from the low-temperature side flow passage is directly supplied to the compressor.

In the air refrigerant type freezing and heating apparatus according to the present invention, the compressing mechanism includes an auxiliary compressor and a main compressor which further pressurizes the air refrigerant pressurized by the auxiliary compressor.

The air refrigerant type freezing and heating apparatus according to the present invention includes a heat recovery unit which recovers heat of the air refrigerant outputted from the heating unit and heats the air refrigerant flowing between the compressing mechanism and the heating unit.

The air refrigerant type freezing and heating apparatus according to the present invention includes a second heating unit which heats the object by the air refrigerant flowing on a subsequent stage side of the heat recovery unit and on a prior stage side of the heat exchanger.

The air refrigerant type freezing and heating apparatus according to the present invention includes a heater which heats the air refrigerant flowing in the heating unit.

In the air refrigerant type freezing and heating apparatus according to the present invention, the heater is an oven.

An air refrigerant type cooling and heating system according to the present invention includes the air refrigerant type freezing and heating apparatus according to the present invention; a regenerator which is filled with an absorbent absorbing a refrigerant different from the air refrigerant, heats and evaporates the refrigerant mixed in the absorbent using the air refrigerant outputted from the compressing mechanism; a condenser which condenses the refrigerant evaporated by the regenerator; an evaporator which evaporates the refrigerant condensed by the condenser and cools a third object by heat of evaporation; and an absorber which allows the absorbent outputted from the regenerator to absorb the refrigerant evaporated by the evaporator and feeds the resultant absorbent to the regenerator.

According to the present invention, an apparatus is provided, which supplies heat with a high efficiency by a heat cycle of the air refrigerant.

According to the present invention, an apparatus is provided, which simultaneously performs freezing and heating by a heat cycle of the air refrigerant.

BEST MODE FOR CARRYING OUT THE INVENTION

First Embodiment

Figure 1:
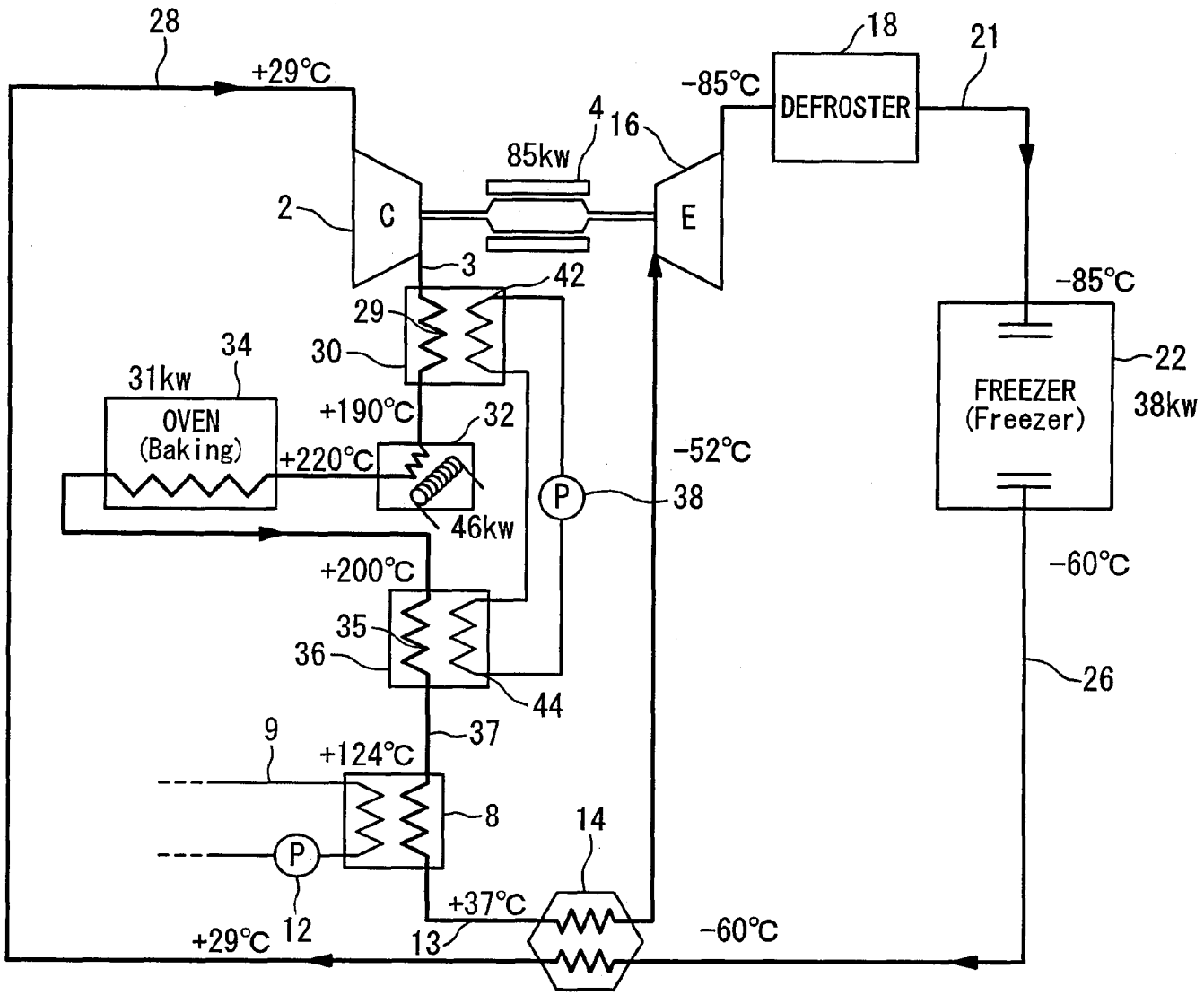
FIG. 1 shows a configuration of an air refrigerant type freezing and heating apparatus according to a first embodiment of the preset invention.

Best modes for carrying out an air refrigerant type freezing and heating apparatus according to the present invention will be described hereinafter with reference to the drawings. FIG. 1 shows a configuration of an air refrigerant type freezing and heating apparatus according to a first embodiment of the present invention.

The air refrigerant type freezing and heating apparatus includes a compressor 2. The compressor 2 is driven by a motor 4. The motor 4 is a synchronous motor rotating at a rotation speed of about 21000 rpm, and a power of the motor 4 is 85 kw.

An air pipe 28 is connected to an inlet side (an upstream side) of the compressor 2. An outlet side (a downstream side) of the compressor 2 is connected to an air passage 29 of a heat exchanger 30 through an air pipe 3. The heat exchanger 30 includes a passage 42, through which a heat transfer medium for exchanging heat with the air in the air passage 29 flows. The heat transfer medium is preferably a liquid such as pressurized water.

The air pipe connected to an outlet side of the air passage 29 is introduced into a heater 32. A power of the heater 32 is 46 kW. The air pipe is introduced into an oven 34 in a downstream of the heater 32. The oven includes a baking chamber, into which a heating object such as bread and cookies is put. The outlet of the air pipe is opened to the baking chamber. An air pipe connected to an outlet side of the oven 34 is connected to an air passage 35 of a heat exchanger 36. The heat exchanger 36 includes a passage 44, trough which the heat transfer medium for exchanging heat with the air in the air pipe 35 flows. The passage 44 is connected to the passage 42 trough a pump 38.

An outlet side of the air pipe 35 is connected to a heat exchanger 8 through an air pipe 37. The heat exchanger 8 includes a pipe 9, through which a heat transfer medium for exchanging heat with the air in the air pipe 37 flows. The pipe 9 is connected to a cooling tower which is not shown. A circulating pump 12 which circulates the water between the heat exchanger 8 and the cooling tower is connected to the pipe 9. An air-cooled heat exchanger may be used as the heat exchanger 8.

An outlet side of an air-side passage of the water cooling heat exchanger 8 is connected to a pipe 13. The pipe 13 is connected to an inlet side of an expansion turbine 16 through a high-temperature-side passage of an exhaust heat recovery heat exchanger 14. The expansion turbine 16 is connected to a shaft of the motor 4 coaxially with the compressor 2.

A pipe on an outlet side of the expansion turbine 16 is connected to a defroster 18 that removes frost. A pipe on an outlet side of the defroster 18 is connected to a freezer inlet pipe 21. The freezer inlet pipe 21 is connected to a freezer 22, and opened to a cooling chamber which contains a cooling object within the freezer 22. The freezer 22 is a storage which includes an openable/closable door and forms a closed cooling chamber inside by closing the door.

The freezer 22 is connected to a pipe 26 which takes in the refrigerant air from the cooling chamber. The pipe 26 is connected to the air pipe 28 through a low-temperature-side passage of the exhaust heat recovery heat exchanger 14.

The air refrigerant type freezing apparatus 1 which includes above-mentioned configuration operates as follows.

(Use of Freezer)

The circulating pump 12 is driven to cause the water to flow in the water pipe 9. The motor 4 is activated to driven the compressor 2 and the expansion turbine 16. The compressor 2 draws and compresses the refrigerant air in the pipe 28. The refrigerant air, of which a temperature and a pressure are increased by being compressed, is discharged to the air pipe 3. The refrigerant air in the air pipe 3 flows into the heat exchanger 8 through the heater 32, the oven 34, and the heat exchanger 36. The refrigerant air is cooled by exchanging the heat between the refrigerant air and the water circulating in the water pipe 9 in the heat exchanger 8.

The refrigerant air outputted from the water cooling heat exchanger 8 flows into the pipe 13. The refrigerant air flowing in the pipe 13 is further cooled in the high-temperature-side passage of the exhaust heat recovery heat exchanger 14 by exchanging the heat between the refrigerant air and the refrigerant air flowing from the pipe 26 into the low-temperature-side passage.

The refrigerant air cooled by the exhaust heat recovery heat exchanger 14 enters the expansion turbine 16 through the pipe on the outlet side of the exhaust heat recovery heat exchanger 14. The refrigerant air is further cooled by an adiabatic expansion in the expansion turbine 16.

The moisture of the refrigerant air outputted from the expansion turbine 16 is removed by the defroster 18. The refrigerant air output from the defroster 18 is supplied into the cooling chamber of the freezer 22, and the freezer 22 is cooled. The internal air of the cooling chamber flows into the pipe 26. The refrigerant air flowing in the pipe 26 is heated by exchanging the heat with the refrigerant air flowing in the high-temperature-side passage of the exhaust heat recovery heat exchanger 14 in the low-temperature-side passage of the exhaust heat recovery heat exchanger 14. The heated refrigerant air flows into the compressor 2 through the pipe 28.

(Use of Oven)

The pump 38 is driven to circulate the heat medium between the passages 42 and 44. The heater 32 is switched on.

The heat transfer medium flowing in the passage 44 is heated by exchanging the heat with the air medium flowing in the air passage 35. The heated heat transfer medium flows into the passage 42. The air flowing in the air passage 29 is heated by exchanging the heat with the heat transfer medium in the passage 42.

The air heated in the air passage 29 is further heated by the heater 32. The heated air is introduced into the baking chamber of the oven 34. An interior of the oven 34 is heated by the air. The air outputted from the oven 34 flows into the air pipe 37 through the air passage 35. Thus, a flow of the refrigerant air on a downstream side is equal to that when the pump 38 and the heater 32 are not activated.

When the operation of the apparatus reaches a steady operation after activating the pump 38 and the heater 32, temperatures of the respective elements are as follows. The temperature of the air refrigerant on the outlet side of the compressor 2 is 114° C. The temperature of the air refrigerant on the outlet side of the heat exchanger 30 is 190° C. The temperature of the air refrigerant on the outlet side of the heater 32 is 220° C. The temperature of the air refrigerant on the outlet side of the oven 34 is 200° C. The temperature of the air refrigerant on the outlet side of the heat exchanger 36 is 124° C. The temperature of the air refrigerant on the inlet side of the freezer 22 is −85° C. A heating ability of the oven 34 is 31 kW.

(Application)

An internal temperature of the oven 34 is about 220° C. Using such an oven 34, the bread, cookies and the like can be baked. The air refrigerant type freezing and heating apparatus according to this embodiment can produce frozen foods using the freezer 22, and can be suitably employed particularly in a food plant that produces both frozen foods and baked products such as bread and cookies.

An efficiency of the air refrigerant type freezing and heating apparatus according to this embodiment can be evaluated using a COP (Coefficient of performance) as follows:

$$\text{Total COP}=(\text{Freezer freezing ability } (Q_1)+\text{Heater heating ability } (Q_2))/(\text{Turbine unit power } (Q_3)+\text{Heater input } (Q_4)).$$

If it is assumed that M denotes an air flow rate (1.54 kg/s), $H_{60}$ denotes an absolute temperature of the freezer outlet 273−60=213K, and $H_{85}$ denotes an absolute temperature of the freezer inlet 273−85=188K, the following equations are established:

$$Q_1=M\times(H_{60}-H_{85})=1.54\ (\text{kg/s})\times(213-188)\ (\text{kJ/kg})=38\ \text{kJ/s}=38\ \text{kW},$$

$$Q_2=31\ \text{kW},$$

$$Q_3=85\ \text{kW, and}$$

$$Q_4=46\ \text{kW}.$$

Accordingly, Total COP=(38+31)/(85+46)=0.53.

On the other hand, the COP of the apparatus performing only baking without freezing is represented as follows, while assuming that $H_{220}$ is a temperature after heating the air and $H_{35}$ is a temperature before heating the air:

$$Q_2/(M\times(H_{220}-H_{35}))=31/(1.54\times(493-308))=0.11.$$

Further, the COP of the apparatus performing only freezing without baking is represented as follows:

$$Q_1/Q_3=38/85=0.44.$$

As described above, the air refrigerant type freezing and heating apparatus according to this embodiment can greatly improve the efficiency if being used for both the freezing and the baking, as compared with use of the apparatus only for the freezing or the baking.

Because of a physical property of the air, the air as high as about 120° C. can be obtained even at a low compression ratio (compression ratio: 2). At a compression ratio of 2, the temperature of a chlorofluorocarbon refrigerant is increased to about 60° C. to 70° C. and that of an ammonium refrigerant is increased to about 70° C. to 80° C. Therefore, the apparatus using the air refrigerant can easily attain the higher efficiency if the apparatus is used for baking.

As an air refrigerant type freezer, a freezer, connected to two compressors for compressing the air and using a motor at a lower rotation speed (several thousands rpm) than that of the motor according to this embodiment, is known. In the case of such a freezer having two compression stage, the temperature of the air refrigerant at an outlet of each compressors is about 60° C. to 70° C., which is lower than the temperature of the single compressor used in the apparatus according to this embodiment. Due to this, if the air refrigerant is heated up to the temperature used for the baking, the apparatus using the single compressor can attain the higher efficiency (COP).

In the air refrigerant type freezing and heating apparatus according to this embodiment, the outlet temperature of the compressor 2 is 114° C., which is higher than a boiling point 100° C. of the water at an atmospheric pressure. Therefore, many applications using this heat are considered. Further, it suffices to output a smaller power necessary to raise the temperature up to the temperature for baking the bread, cookies, and the like from an external heat source, thereby improving the efficiency.

According to this embodiment, the air refrigerant at 190° C. outputted from the heat exchanger 30, the air refrigerant at 220° C. obtained by being heated by the heater 32, and the air refrigerant at 124° C. flowing from the heat exchanger 36 can be used for various purposes. They can be suitably used in, for example, a drying machine, a heat sterilizer, a floor heating system, and an air conditioning system using a radiator and the like.

Figure 2:
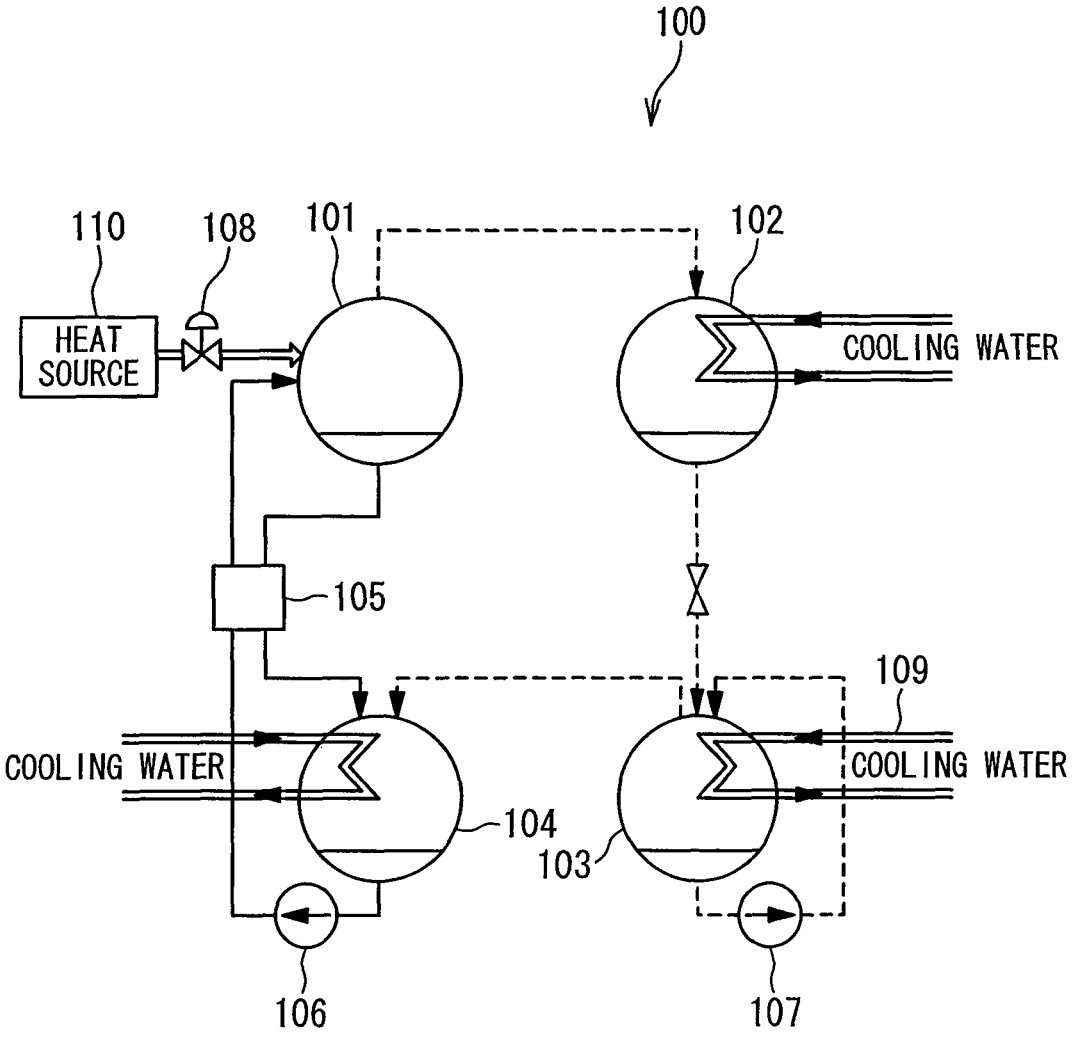
FIG. 2 shows a configuration of an absorption freezer connected to the air refrigerant type freezing and heating apparatus.

Furthermore, by employing the air refrigerant type freezing and heating apparatus according to the present invention while being connected to an absorption freezer, a high efficiency can be attained as a whole. FIG. 2 shows a configuration of the absorption freezer. The absorption freezer 100 is composed of heat exchangers of a regenerator 101, a condenser 102, an evaporator 103, an absorber 104, and a heat exchanger 105 as well as a solution pump 106, a refrigerant pump 107, and a control valve 108.

The regenerator 101 is provided to generate a refrigerant steam by heating a refrigerant solution by heat supplied from a heat source 110 and evaporating a refrigerant component. As this heat source 110, heat of the air refrigerant at 190° C. outputted from the heat exchanger 30, heat of the air refrigerant at 220° C. obtained by being heated by the heater 32, or heat of the air refrigerant at 124° C. outputted from the heat exchanger 36 is used.

The condenser 102 is provided to condense the refrigerant steam generated by the regenerator 101 into a refrigerant liquid. The evaporator 103 is provided to perform a heat exchange between the refrigerant liquid generated by the condenser 102 and the cooling water flowing in the pipe 109 to thereby cool the cooling water to a predetermined temperature. In addition, the evaporator 103 is provided to evaporate the refrigerant liquid to generate the refrigerant steam. The absorber 104 is provided to allow the regenerator 101 to absorb the refrigerant steam generated by the evaporator 103 in a solution remaining after evaporating the refrigerant component, thereby preparing the refrigerant solution. The heat exchanger 105 is provided to perform a heat exchange between the refrigerant solution generated by the absorber 104 and the solution remaining after the evaporation of the refrigerant component. The solution pump 106 is provided to circulate the refrigerant solution between the regenerator 101 and the absorber 104. The control valve 108 is provided to control an inflow amount of the heat source supplied to the regenerator 101.

The absorption freezer 100 is mainly intended to cool the cooling water flowing in the pipe 109 to a predetermined temperature using heat of evaporation of the refrigerant liquid within the evaporator 103. By connecting the air refrigerant type freezing and heating apparatus to the absorption freezer 100, a cooling and heating system having a high efficiency and available as a heat source at various temperatures is provided.

Second Embodiment

Figure 3:
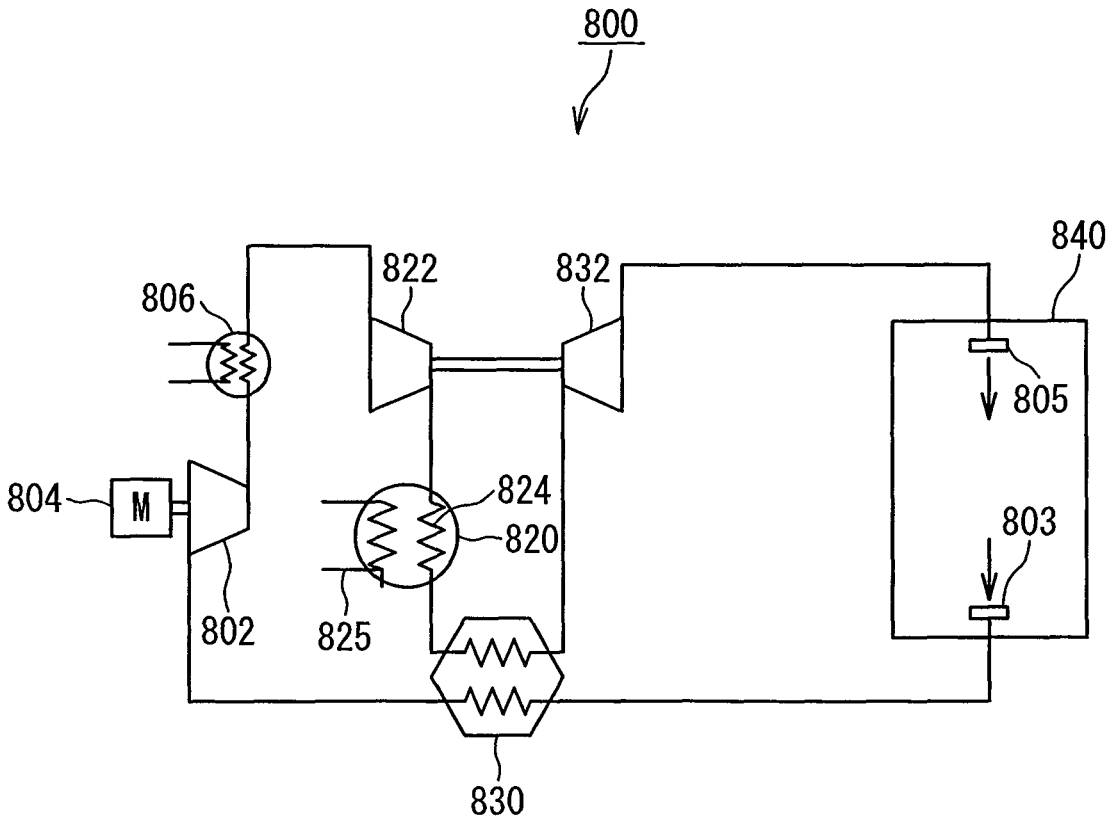
FIG. 3 shows a configuration of an air refrigerant type freezing and heating apparatus according to a second embodiment of the present invention.

FIG. 3 shows a configuration of an air refrigerant type freezing and heating system according to a second embodiment of the present invention.

The air refrigerant type cooling and heating system 800 according to this embodiment includes an auxiliary compressor 802, a motor 804, an auxiliary cooler 806, a main compressor 822, a first heat exchanger 820, a second heat exchanger 830, an expansion turbine 832, and a cooling chamber 840. The auxiliary compressor 802 is driven by the motor 804. An outlet side of the auxiliary compressor 802 is connected to the auxiliary cooler 806 through a pipe. An outlet side of the auxiliary cooler 806 is connected to the main compressor 822 through a pipe. The main compressor 822 is connected coaxially with the expansion turbine 832.

An outlet side of the main compressor 822 is connected to a high-temperature-side pipe 824 of the cooler 820 through a pipe. An outlet side of the high-temperature-pipe 824 of the cooler 820 is connected to a high-temperature-side passage of the heat exchanger 830. An outlet side of the high-temperature-side passage of the heat exchanger 830 is connected to the expansion turbine 832. An outlet side of the expansion turbine 832 is connected to an air outlet 805 of the cooling chamber 840. The cooling chamber 840 includes an air inlet 803, and the air inlet 803 is connected to a low-temperature-side passage of the heat exchanger 830 through a pipe. An outlet side of the low-temperature-side passage of the heat exchanger 830 is connected to the auxiliary compressor 802.

An operation principle of the air refrigerant type cooling apparatus 800 according to this embodiment will be described.

The motor 804 is driven to thereby rotate the auxiliary compressor 802. The auxiliary compressor 802 discharges the refrigerant air. The auxiliary cooler 806 is activated. The refrigerant air discharged from the auxiliary compressor 802 is cooled by the auxiliary cooler 806, and outputted to the main compressor 822. The refrigerant air flows into the main compressor 822, thereby rotating the main compressor 822 and the expansion turbine 832. A temperature of the refrigerant air discharged from the main compressor 822 is about 60° C. to 70° C. This refrigerant air is cooled by the first heat exchanger 820. The refrigerant air outputted from the first heat exchanger 820 is further cooled by the second heat exchanger 830. The refrigerant air outputted from the second heat exchanger 830 is further cooled by the expansion turbine 832, and supplied to the cooling chamber 840 from the air outlet 805. The internal air 840 of the cooling chamber 840 is taken in from the air inlet 803 and supplied to the auxiliary compressor 802 through the low-temperature-side pipe of the second heat exchanger 830.

In the heat exchanger 820, a heat transfer medium such as the water flowing in the low-temperature-side pipe 825 is heated by a heat of the refrigerant air at about 60° C. to 70° C. supplied to the high-temperature-side pipe. The heat medium thus heated is used for the floor heating system, to supply hot water or the like. By using the heater that heats the heat transfer medium outputted from the low-temperature-side pipe 825 of the heat exchanger 820, it is possible to apply the apparatus 800 to an instance of requiring the heat transfer medium at a higher temperature.

The tangible values of temperatures, powers, coefficients, flow rates and so on, described in "Best Mode for Carrying out the Invention", are examples. The present invention is not limited to those tangible values.

The invention claimed is:

1. An air refrigerant type freezing and heating apparatus comprising:

a compressing mechanism which compresses an air refrigerant;

a first heating unit which heats a first object by said air refrigerant outputted from said compressing mechanism;

a first heat exchanger which cools said air refrigerant outputted from said first heating unit;

a turbine which expands said air refrigerant outputted from said first heat exchanger;

a cooler which cools a second object different from said first object by said air refrigerant outputted from said turbine;

a heater which heats said air refrigerant flowing in said first heating unit; and a heat recovery unit which recovers heat of said air refrigerant outputted from said first heating unit and heats said air refrigerant flowing from said compressing mechanism to said first heating unit, wherein said heat recovery unit comprises:

a second heat exchanger arranged between said compressing mechanism and said heater;

a third heat exchanger arranged between said first heating unit and said first heat exchanger; and a pump which circulates a heat transfer medium between said second heat exchanger and said third heat exchanger.

2. The air refrigerant type freezing and heating apparatus according to claim 1, wherein said compressing mechanism is composed of a single compressor.

3. The air refrigerant type freezing and heating apparatus according to claim 1, further comprising:

a second heating unit which heats an object by said air refrigerant flowing on a subsequent stage side of said heat recovery unit and on a prior stage side of the heat exchanger.

4. The air refrigerant type freezing and heating apparatus according to claim 1, wherein said first heating unit is an oven.

5. An air refrigerant type cooling and heating system comprising:

a compressing mechanism which compresses an air refrigerant, a first heating unit which heats a first object by said air refrigerant outputted from said compressing mechanism;

a first heat exchanger which cools said air refrigerant outputted from said first heating unit, a turbine which expands said air refrigerant outputted from said first heat exchanger, and a cooler which cools a second object different from said first object by said air refrigerant outputted from said turbine;

a regenerator which is filled with an absorbent absorbing a refrigerant different from the air refrigerant, heats and evaporates said refrigerant mixed in said absorbent by using said air refrigerant outputted from said compressing mechanism;

a condenser which condenses said refrigerant evaporated by said regenerator;

an evaporator which evaporates said refrigerant condensed by said condenser and cools a third object by heat of evaporation;

an absorber which allows said absorbent outputted from said regenerator to absorb said refrigerant evaporated by said evaporator and outputs said absorbent to said regenerator;

a heater which heats said air refrigerant flowing in said first heating unit; and a heat recovery unit which recovers heat of said air refrigerant outputted from said first heating unit and heats said air refrigerant flowing from said compressing mechanism to said first heating unit, wherein said heat recovery unit comprises:

a second heat exchanger arranged between said compressing mechanism and said heater;

a third heat exchanger arranged between said first heating unit and said first heat exchanger; and a pump which circulates a heat transfer medium between said second heat exchanger and said third heat exchanger.

6. The air refrigerant type freezing and heating apparatus according to claim 1, wherein the compressing mechanism is a compressor which rotates coaxially with said turbine, said air refrigerant taken in from said cooler is supplied to a low-temperature side flow passage of said heat exchanger, and said air refrigerant outputted from said low-temperature side flow passage is directly supplied to said compressor.

7. The air refrigerant type cooling and heating system according to claim 5, wherein said compressing mechanism is composed of a single compressor.

8. The air refrigerant type cooling and heating system according to claim 5, wherein said air refrigerant type freezing and heating apparatus further includes:

a second heating unit which heats an object by said air refrigerant flowing on a subsequent stage side of said heat recovery unit and on a prior stage side of the heat exchanger.

9. The air refrigerant type cooling and heating system according to claim 5, wherein said first heating unit is an oven.

* * * * *